United States Patent [19]

Del Fabbro

[11] 4,435,081

[45] Mar. 6, 1984

[54] CONCRETE MIXING PLANTS WITH ELEVATOR WHEEL

[75] Inventor: Dino Del Fabbro, Basaldella di Campoformido, Italy

[73] Assignee: Officine Riunite Udine Spa, Italy

[21] Appl. No.: 355,371

[22] Filed: Mar. 8, 1982

[30] Foreign Application Priority Data

Mar. 20, 1981 [IT] Italy ..... 83345 A/81

[51] Int. Cl.[3] ..... B01F 15/02

[52] U.S. Cl. ..... 366/18; 366/33; 366/38; 366/141; 366/156; 366/181

[58] Field of Search ..... 177/70; 198/397, 549, 198/559, 612, 701, 703; 366/14, 15, 16, 18, 20, 26, 30, 33, 38, 134, 135, 141, 154, 155, 156, 158, 181, 195

[56] References Cited

U.S. PATENT DOCUMENTS

| | | | |
|---|---|---|---|
| 2,608,394 | 8/1952 | Williamson | 366/18 |
| 3,110,421 | 11/1963 | Matthias | 366/18 X |
| 3,262,509 | 7/1966 | Schellentrager | 177/70 X |
| 4,078,650 | 3/1978 | Dixon | 198/397 |

FOREIGN PATENT DOCUMENTS

| | | |
|---|---|---|
| 338102 | 12/1926 | Belgium . |
| 598469 | 2/1932 | Fed. Rep. of Germany . |
| 1309341 | 10/1962 | France . |
| 1016613 | 1/1966 | United Kingdom . |
| 1128501 | 9/1968 | United Kingdom . |

*Primary Examiner*—Robert W. Jenkins
*Assistant Examiner*—Arthur D. Dahlberg
*Attorney, Agent, or Firm*—Stevens, Davis, Miller & Mosher

[57] ABSTRACT

The invention relates to concrete mixing plant suitable for weighing and mixing at least two aggregate materials and cement inside a concrete mixer comprising a container to collect aggregate, weighing and/or dosing scale, a worm-screw to deliver cement, a concrete mixer or mixing machine means whereby the whole is borne by a plurality of legs and/or supports possibly to sustain a silo holding cement, and an elevator wheel suitable for receiving and premixing the aggregates, the wheel being located between the container collecting aggregate and the concrete mixer suitable for receiving the aggregates and cement.

6 Claims, 3 Drawing Figures

CONCRETE MIXING PLANTS WITH ELEVATOR WHEEL

This invention relates to concrete improved mixing plants with an elevator wheel.

To be more specific, this invention relates to plants with improvements in the weighing and dosing, loading into a concrete mixer and mixing various materials for building purposes, such as cement, aggregate and/or loose conglomerates.

Various plants, equipment and systems for mixing concrete specifically for use in building work are known, and it is known that the plants and systems involve many short comings.

In G.B. No. 1,016,613 a known continuous concrete mixer is described which includes a rotating drum mounted on a fixed frame and a fixed casing arranged coaxially with the drum and having two adjacent chambers containing means for feeding cement and aggregates, the drum being provided with three distinct zones.

The above-described mixer, beside being of a rather complex construction, does not provide a precise weighing of the concrete constituents but only an approximate proportioning since the components are statically and dynamically connected among themselves.

There are other known concrete mixers, such as those described in FR No. 1.309.341 and in BE-A-338,102 which also suffer, despite the inclusion of some kind of weighing means, from the problem of imprecise weighing of the concrete constituents.

It is known that, notwithstanding the number of devices adopted in some of the plants, it is not possible to obtain adequate pre-mixing.

It is also known that the plants and equipment comprise means to transfer and convey materials, the means being, for instance, chutes, conveyor belts or other means which take-up a great deal of space, and this fact does not always make them welcome on all building sites.

Moreover, owing to their overall bulk a great loss of time and high costs are involved in moving and setting them up at a new building site.

It is also known that the transfer and conveyor means consist of mechanical, or other parts which are readily subject to wear, such as rollers, belts, bearings or other parts, and which therefore need continuous examination and frequent maintenance.

Furthermore, owing to the types of transfer means employed the known plants and equipment cannot be readily sheltered from bad weather, and this fact can create difficulties and complications when there is dampness or rain or wind.

In fact, in the case of dampness the cement and conglomerates tend to stick to the conveyor belts, while the cement tends to be lost in the air when there is wind.

The improvements of this invention enable the shortcomings and drawback of the known art to be avoided by means of a concrete mixing plant which is simple, easy to handle and outstanding reliable. The improvements also enable a concrete mixing plant to be embodied which has a compact from and very modest sizes, whereby also a noteworthy saving of space can be obtained.

In particular, the compact form makes it possible to render the plant mobile or possibly to motorize it and to make it movable on wheels in a possibly independent way. By virtue of the special transport and conveyor means employed, the improvements of this invention also enable a concrete mixing plant to be embodied which does not need continuous inspection and frequent maintenance and which permits a great saving of energy to be obtained. The improvements of this invention also make possible a pre-mixing of the materials during their transfer phase and lessen the mixing times in the concrete mixer in this way at least partially.

The invention is there embodied by concrete mixing plants suitable for dosing and mixing at least two aggregate materials and cement, inside a concrete mixer or mixing machine, the plants comprising container means to collect aggregate, weighing and/or dosing means, wormscrew means to transfer cement, and concrete mixer or mixing machine means, whereby the whole is upheld by a plurality of legs and/or supports which enable sustaining silo means holding cement, the plants being characterized by including:

container means to collect aggregate, and wormscrew means, sustained by weighing and/or dosing means, and elevator wheel means suitable for receiving and premixing the aggregates, the wheel means being positioned between the container means collecting aggregate and the concrete mixer or mixing machine means suitable for receiving the aggregates and cement.

Other details and features of the invention will stand out from the description given below by way of nonlimitative example and with reference to the accompanying drawings, in which.

Figure 1:
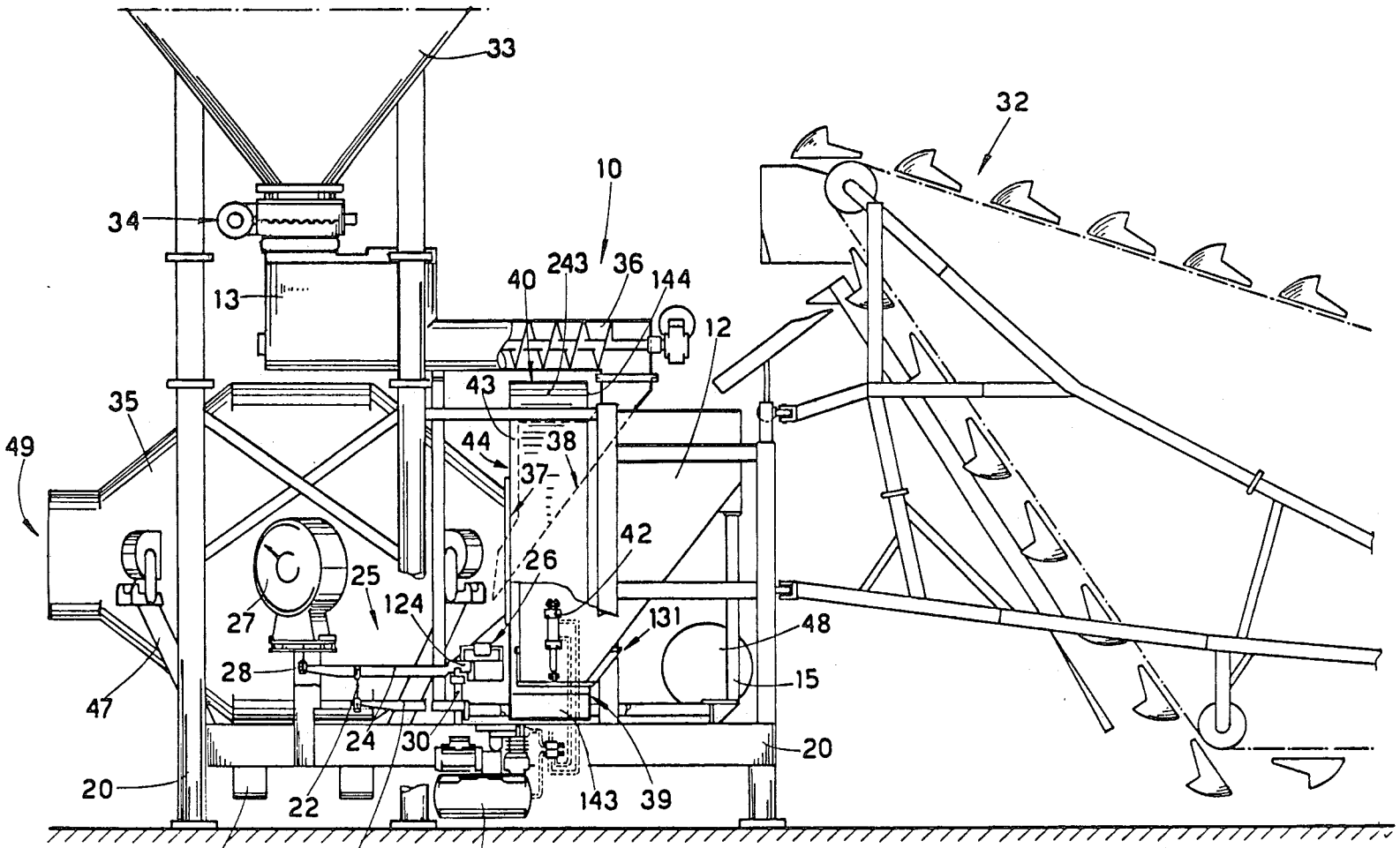
FIG. 1 shows a diagrammatical side view of the concrete mixing plant according to the invention.
Figure 2:
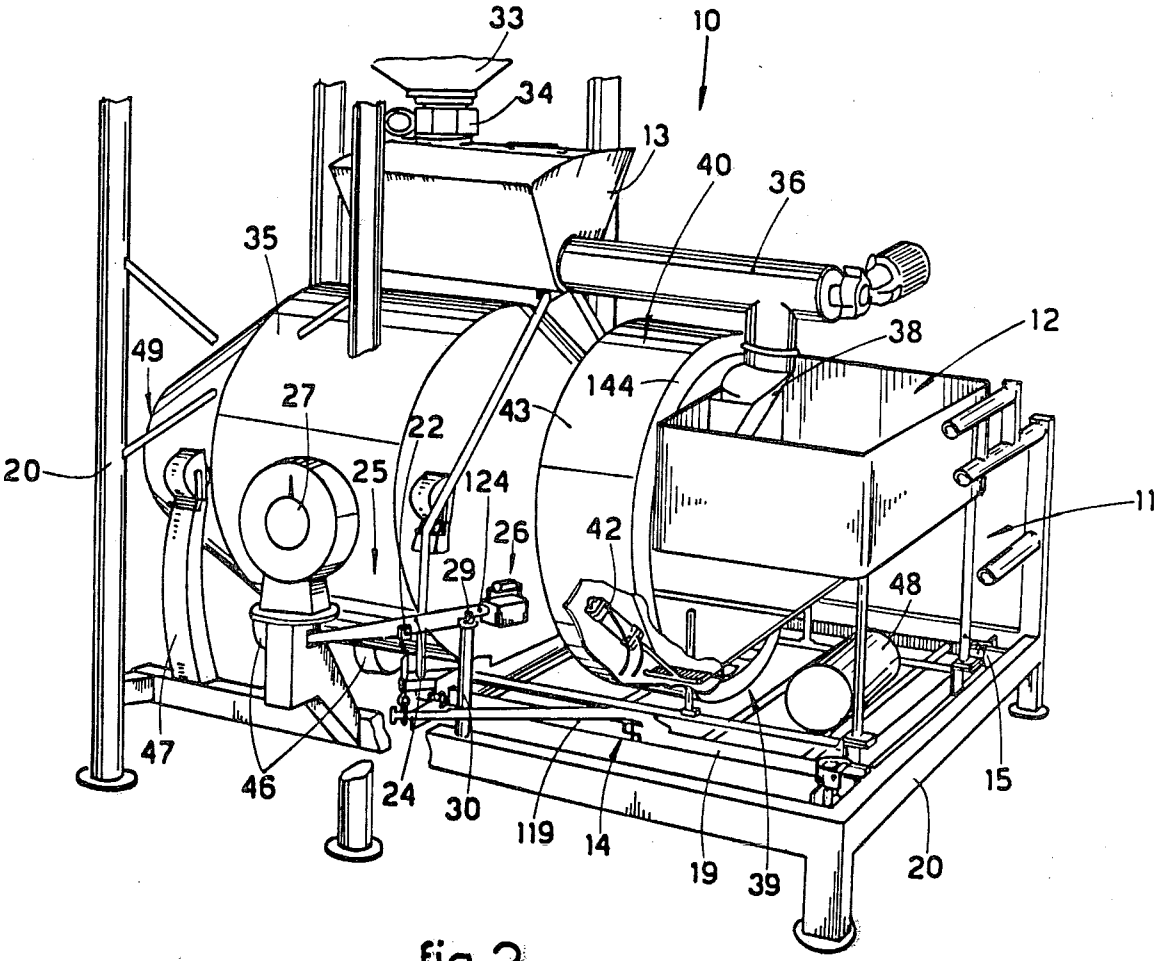
FIG. 2 shows a perspective view of the concrete mixing plant.
Figure 3:
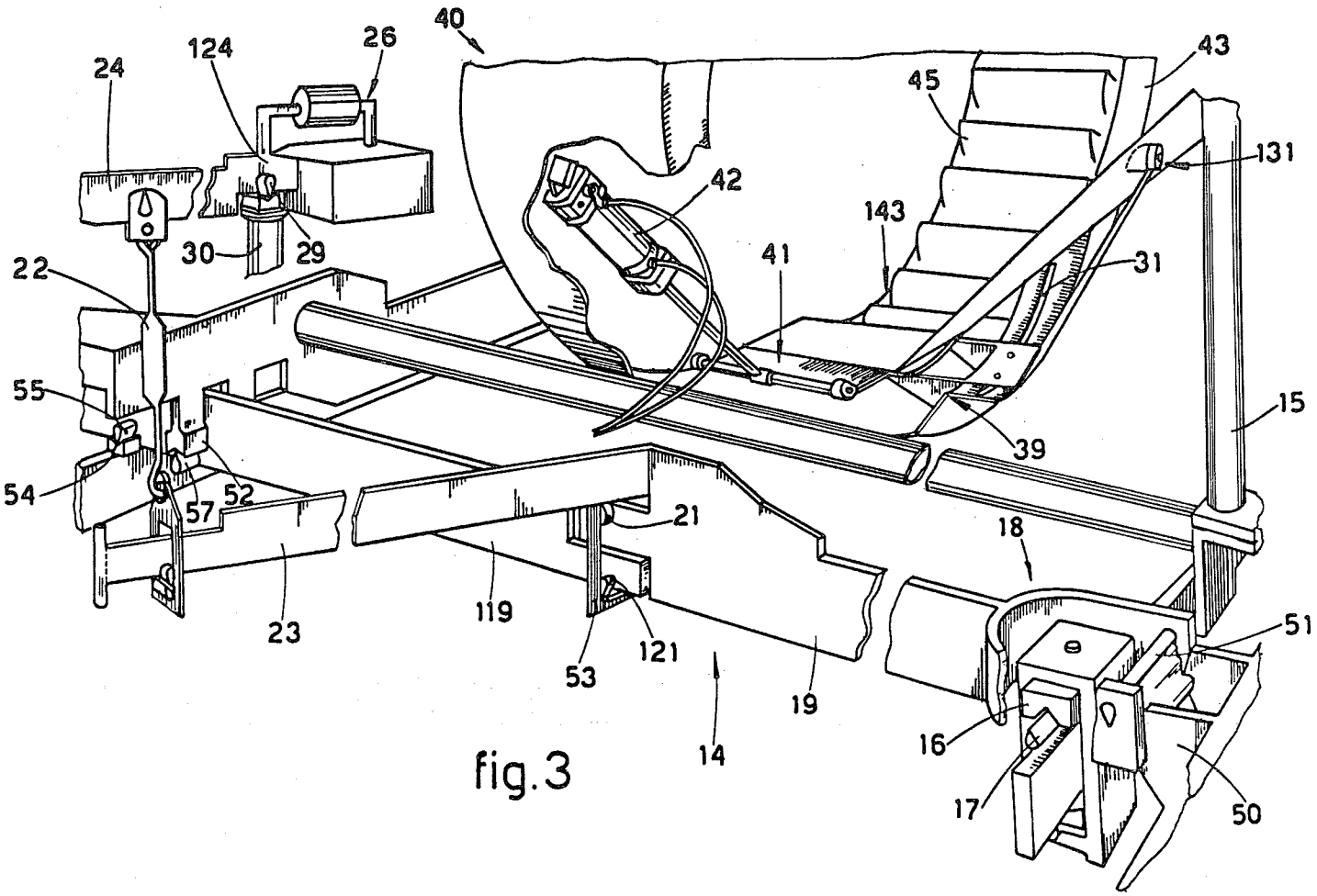

FIG. 3 gives a three-dimensional view of a detail of the weighing means of FIG. 1.

The concrete mixing plant 10 serves advantageously to make cement conglomerate containing loose aggregate of various type and of various mixes, and also cement and water.

In particular, the concrete mixing plants 10 includes balance type weighing and/or dosing means 11 which comprise hopper or container means 13 for cement, hopper or container means 12 to collect aggregate and a weighing device 14, which in this instance is of a weighbridge type and cooperates with the containers or hoppers 12 and 13.

In particular, the containers or hoppers 12 and 13 rest on a frame 15, which is supported, by means of suitable, upright, opposed bearing and blade means 16, on blade and bearing elements 17 cooperating in a corresponding manner with the aforesaid means 16.

The blade and bearing elements 17 are solidly anchored to the ends 18 of suitable lever means 19.

In substance the frame 15 and containers or hoppers 12 and 13 rest on the lever means 19, and in their turn said lever means 19 rest on fixed supporting points 50 by means of elements 51 in such a way that they can rotate in respect of said fixed points 50.

At its other end the frame 15 rests, by means of bearings 52 and blades 57, on lever means 119 which cooperate with the lever means 19 through connecting bridge elements 53, as shown in FIG. 3.

In particular, the lever means 119 rest on fixed points 54 with blade means 55 in such a way that they can rotate in respect of the fixed points 54 owing to the weight of the frame 15 and of the hoppers 12 and 13.

In substance, during weighing the lever means 19, 119 oscillate, remaining mutually connected by connecting bridge elements 53, whereby the lever means 19, 119 cooperate with the elements 53 through upright blade elements 21, 121, as shown in FIG. 3.

The rotary motion is transmitted to upright tie bar means 22 through an arm 23 which is part of the lever means 19.

The upright tie bar 22 acts on the arm 24 of the weighbridge means 25, which include on the arm 124 calibrating means 26 with a counterweight.

The end of the arm 24 is able to actuate the pointer of a graduated scale 27 through suitable tie bar or lever means 28 (FIG. 1).

Moreover, the system of the arms 24, 124 pivots at a point 29 and is suitably sustained by vertical rod 30.

The container means 12 to collect aggregate cooperate with one or more loaders 32 of the bucket conveyor type, for instance.

The loaders 32 can also be of a conveyor belt type or bar type or power shovel type or of another type.

In substance, the aggregate is charged into the container means collecting aggregate and is weighed separately with progressive weighings or with one single weighing.

The cement too in the hopper 13 is weighed separately or with progressive weighings, being made to flow from a containing silo 33.

In particular, the flow of cement into the hopper 13 is regulated or dosed by operating a valve 34 with powered means or by hand. If powered means are employed, it is possible to use a motor valve governed by automatic means controlling and regulating the weighing.

The cement weighed is moved from the hopper 13 directly into the concrete mixer 35 so as to be mixed with the aggregate transferred thither from the container means 12.

In particular, the movement of the cement is carried out with worm-screw means 36 to transfer cement, and the worm-screw 36 sends the cement into the concrete mixer 35 through the charging inlet 37 of the mixer 35 along suitable chute means 38.

At the same time as the cement is transferred, the aggregate is delivered from the container means 12 collecting aggregate into the concrete mixer 35.

The delivery of the aggregate is carried out by opening suitable adjustable discharge means 39 located at the bottom of the container means 12 and able to let the aggregate drop into the elevator wheel 40.

The means 39 are of a sliding door type 41 but can also be of a different type.

The sliding door 41 runs on suitable guides 31 and is advantageously hinged at 131.

The door 41 is operated with jack means 42 appropriately fed by suitable means.

However, actuators of another type having, for instance, an electric motor or other means can be used.

The elevator wheels 40 consists substantially of a revolving drum 43 connected frontally to the charging inlet 37 of the concrete mixer 35 by means of a wall 44 and having a wall 144 of small dimensions cooperating with the container means 12.

Furthermore, inside the revolving drum 43 there is a plurality of vanes 45 jutting out from the circumferential end of the revolving drum 43. The vanes 45 can be fixed or suitably movable.

In this way the aggregate coming from the container 12 descends into the lower part 143 of the revolving drum 43 and is then carried by rotation into the upper part 42 of drum 43, whence it falls back onto the chute means 38 and therefrom into the concrete mixer 35.

In particular, by falling onto the chute 38 the aggregate creates a continuous movement on the chute 38 and is mixed in this way with the cement coming from the hopper 13.

The elevator wheel transfer means 40, therefore, perform the twofold function of charging the aggregate into the concrete mixer 35 and of pre-mixing it with the cement.

The rotary action of the drum 43 can be derived from the rotation of the concrete mixer itself 35, which is of a drum type with a horizontal axis resting on drive rolls 46 located below the concrete mixer 35 and working in coordination with guide rolls 47 arranged on the sides of the concrete mixer 35.

It is also possible that the revolving drum 43 is operated separately by suitable drive means which enable the speed of rotation of the drum to be regulated as wished for the purpose of obtaining a diverse speed of charging and/or diverse pre-mixing.

The water for the cement conglomerate mix can be poured into the concrete mixer 35. This water can be drawn from the tank 48 and delivered with suitable known means.

At the end of mixing, steps are then taken to discharge the cement conglomerate mix from the concrete mixer 35 through its discharge outlet 49.

Further a device can control, in a continuous production cycle, the re-starting of the cycle of charging and dosing new materials into the containers or hopper 12 or 13 when the materials previously held therein have been wholly delivered into the concrete mixer 35.

Furthermore, in the same continuous production cycle, devices can govern automatically the charging and discharging of the concrete mixer 35.

The various operations may be fulfilled by controlling them by hand or semiautomatically or automatically.

The concrete mixing plant 10 has a bearing structure 20 consisting of a plurality of legs and/or supports, to which are anchored the silo 33 and other rigid parts of the plant intself 10 and to which the loaders 32 can be anchored.

An embodiment of the invention has been described, but variants are possible for a technician in this field; thus the proportions, shapes and sizes can be varied.

It is possible that the plant according to the invention can be used to treat various materials and substances, not only those for building purposes but also those such as feeding stuffs, fodder, salts, dyes, etc., for example.

It is possible that the cement charged into the hopper 13 is weighed separately with weighing scale means or with a weighing device other than the device 14, the purpose being to carry out weighing separately at one and the same time and thereby to reduce the overall times needed for dosing.

A weighing device 14 can be employed which makes use of elastic support means, for instance, with spiral or leaf springs rather than lever means.

It is also possible to use a weighing device of another type such as load cells.

Moreover, it is possible that, owing to its compact form and modest size, the concrete mixing plant 10 can be arranged on a possibly powered movable means.

It is also possible to the use several silos 33 of which each is located in cooperation with its own valve 34. It is possible to use several chutes 38 variously conformed and to have the inner surface of the revolving drum 43 rough or of a different profile or devoid, or not, of vanes 45.

It is possible to pre-dispose vibrator means cooperating with the container means 12 collecting aggregate, the purpose being to enable all the material container therein 12 to be discharged into the lower part 143 of the revolving drum 43. The concrete mixer can be replaced with a mixing machine, etc.

These and other variants are all possible for a technician in this field without departing from the scope of the invention.

I claim:

1. Concrete mixing plant for dosing and mixing aggregate materials and cement inside a concrete mixer or mixing machine, comprising a container to collect aggregate, a conveyor and chute means for delivering cement to said mixer, weighing and/or dosing means supporting said aggregate container and cement conveyor and chute means, a concrete mixer having a charging inlet, a plurality of legs and/or supports to uphold said aggregate container, cement conveyor and chute means and weighing means, and an elevator wheel for receiving and premixing the aggregates, said wheel being located between the container and the concrete mixer and connected frontally to the charging inlet, said cement chute means passing through the interior space of said elevator wheel, a portion of said container positioned within the interior space of said elevator wheel said elevator wheel delivering aggregate onto cement being delivered to said mixer.

2. The concrete mixing plant as in claim 1, including a hopper for receiving cement which communicates with said conveyor and chute means to deliver cement into a charging inlet of the concrete mixer.

3. The concrete mixing plant as in claim 1 or claim 2, wherein said container receives aggregate at its top and introduces aggregate into the inside of the bottom of the elevator wheel, said container defining an adjustable discharge means substantially at its bottom.

4. The concrete mixing plant as in claim 1 or claim 2 wherein said elevator wheel comprises inner peripheral vanes to lift said aggregate and discharge it substantially above the cement running in the chute.

5. The concrete mixing plant as in claim 4 wherein the vanes are fixed.

6. The concrete mixing plant as in claim 4 wherein the vanes are of a configuration to hold and lift aggregate as the drum rotates.

* * * * *